US007317886B2

(12) United States Patent
Takuwa

(10) Patent No.: US 7,317,886 B2
(45) Date of Patent: Jan. 8, 2008

(54) IMAGE FORMING APPARATUS HAVING TONER REPLENISHING FEATURES

(75) Inventor: Noriyuki Takuwa, Kawasaki (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 6 days.

(21) Appl. No.: 11/226,323

(22) Filed: Sep. 15, 2005

(65) Prior Publication Data

US 2006/0204276 A1 Sep. 14, 2006

(30) Foreign Application Priority Data

Mar. 10, 2005 (JP) ..... 2005-067481
Mar. 10, 2005 (JP) ..... 2005-067482
Mar. 10, 2005 (JP) ..... 2005-067483

(51) Int. Cl.
*G03G 15/00* (2006.01)

(52) U.S. Cl. ..... 399/110

(58) Field of Classification Search ..... 399/110
See application file for complete search history.

(56) References Cited

U.S. PATENT DOCUMENTS 6,091,912 A * 7/2000 Kitajima et al. ..... 399/13
2003/0072584 A1* 4/2003 Cho ..... 399/110

FOREIGN PATENT DOCUMENTS

| | | | |
|---|---|---|---|
| JP | 07-320133 | A | 12/1995 |
| JP | 08-050412 | A | 2/1996 |
| JP | 11-242367 | A | 9/1999 |
| JP | 2000-294948 | A | 10/2000 |
| JP | 2002-021387 | A | 1/2002 |
| JP | 2002-023439 | A | 1/2002 |
| JP | 2003-217734 | A | 7/2003 |
| JP | 2004-271841 | A | 9/2004 |

* cited by examiner

*Primary Examiner*—David M. Gray
*Assistant Examiner*—Bryan Ready
(74) *Attorney, Agent, or Firm*—Foley & Lardner LLP

(57) ABSTRACT

A fixing unit as an embodiment of the present invention has a main body frame to contain a photoconductive drum and a fixing unit, a protection cover which is placed in a space to a toner drum and has a three-dimensional structure to form an air layer in a clearance to the main body frame, a first cover and second cover rotated on the same rotating axis, and a knob and knob which are formed on the first cover and second cover, respectively, and placed on different surfaces.

12 Claims, 8 Drawing Sheets

IMAGE FORMING APPARATUS HAVING TONER REPLENISHING FEATURES

CROSS-REFERENCE TO RELATED APPLICATIONS

This application is based upon and claims the benefit of priority from prior Japanese Patent Applications No. 2005-067481, filed Mar. 10, 2005; No. 2005-067482, filed Mar. 10, 2005; and No. 2005-067483, filed Mar. 10, 2005, the entire contents of all of which are incorporated herein by reference.

BACKGROUND OF THE INVENTION

1. Field of the Invention

The present invention relates to an image forming apparatus, and in particular to an image forming apparatus having an openable cover for replacing a toner bottle containing toner for replenishment during image forming operation.

2. Description of the Related Art

Generally, an image forming apparatus has a developing unit, a fixing unit and a charger for forming an image in a main body frame. A main body frame has an openable cover for replacing a toner bottle containing developer. The user opens the cover when replacing the toner bottle placed at a predetermined position with respect to the developing unit.

Such an image forming apparatus is available in a type capable of replacing the toner bottle by opening the cover during image forming operation.

However, during image forming operation, electricity is supplied to the developing unit and fixing unit. Therefore, the user's safety must be ensured when a toner bottle is replaced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF SUMMARY OF THE INVENTION

According to an aspect of the present invention, there is provided an image forming apparatus comprising:

an image carrier to carry an electrostatic latent image;

a developer containing container to contain developer;

a developing unit to supply the image carrier with the developer supplied from the developer containing container;

a fixing unit which applies heat and pressure to a transfer medium transferred with the developer image formed on the image carrier, and fuses and fixes the developer image to the transfer medium;

a main body case to contain at least the image carrier, developing unit and fixing unit; and a protection cover which is provided between the main body case and developer containing container, and has a three-dimensional structure to form an air layer in a clearance to the main body case.

According to another aspect of the present invention, there is provided an image forming apparatus comprising:

an image carrier to carry an electrostatic latent image;

a developer containing container to contain developer;

a developing unit to supply the image carrier with the developer supplied from the developer containing container;

a fixing unit which applies heat and pressure to a transfer medium transferred with the developer image formed on the image carrier, and fuses and fixes the developer image to the transfer medium;

a main body case to contain at least the image carrier, developing unit and fixing unit;

a protection cover which is provided between the main body case and developer containing container, and has a three-dimensional structure to form an air layer in a clearance to the main body case;

a first cover provided rotatably in the main body case;

a second cover rotated to open/close on the same rotating axis as the first cover;

a first interrupt unit which interrupts power supply to a first operating unit for supplying the developer from the developer containing container to the developing unit, when the first cover is opened; and a second interrupt unit which interrupts power supply to a second operating unit for operating at least the developing unit, when the second cover is opened.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 8 is a schematic perspective viewed from the front side of the image forming apparatus shown in. FIG. 1, with the covers removed;

DETAILED DESCRIPTION OF THE INVENTION

An embodiment of the present invention will be explained hereinafter with reference to the accompanying drawings.

Figure 1:
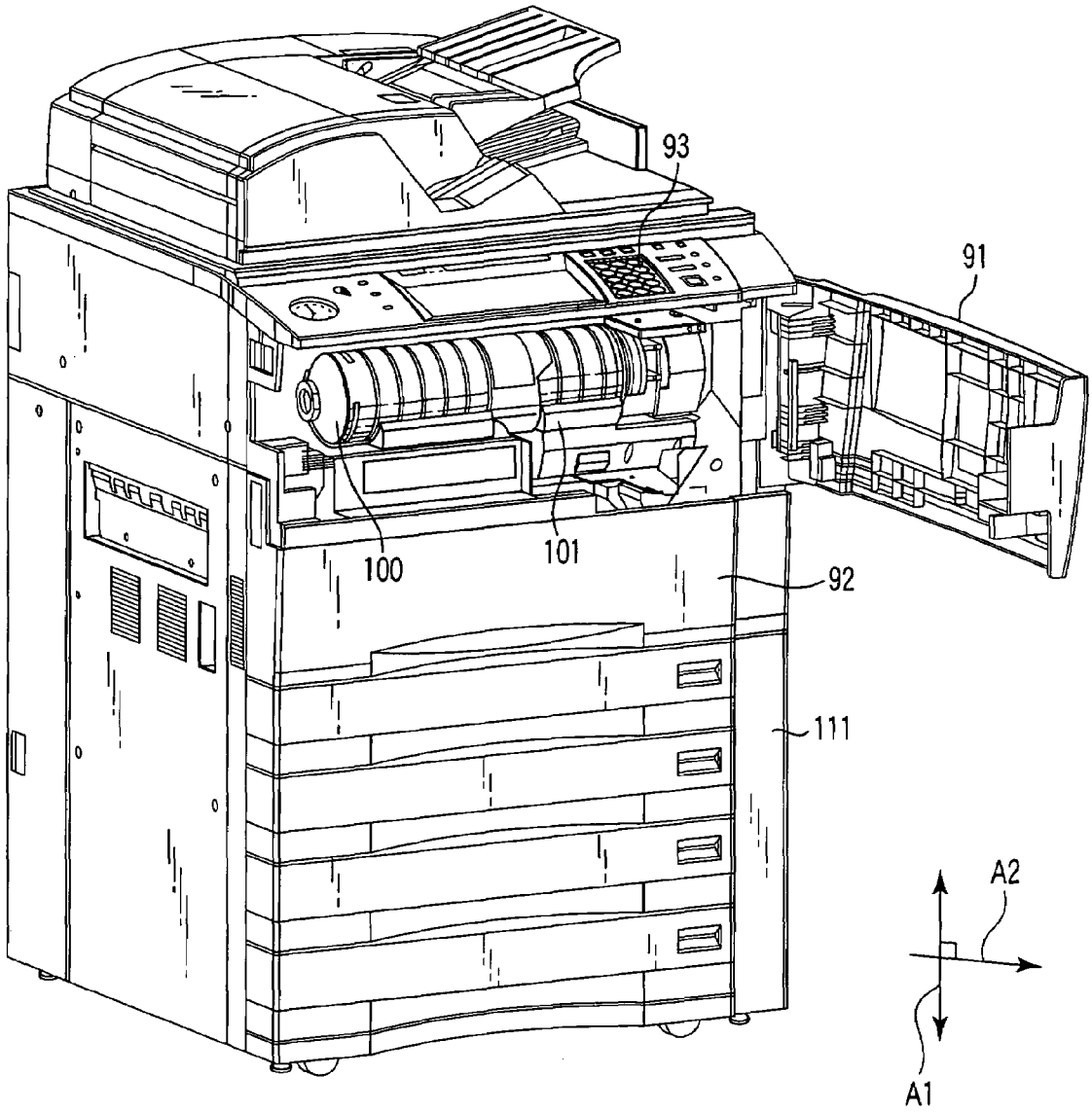
FIG. 1 is an external view showing the configuration of an image forming apparatus according to an embodiment of the present invention.

FIG. 1 is an external view showing the configuration of an image forming apparatus according to an embodiment of the present invention.

FIG. 1 is a perspective of an image forming apparatus 1 viewed from the front side, in the state that a first cover 91 and a second cover 92 are hinged to the apparatus and opened or closed when moved rotationally. Explained in detail, the first cover 91 is fixed to a main body frame 111 covering the whole image forming apparatus 1 openably in a second direction (the arrow A2, horizontal) through a fixed axis placed on a rotating axis in a first direction (the arrow A). In this embodiment, the first direction is vertical to the image forming apparatus 1 and the second direction is horizontal to the apparatus.

The first cover 91 is used to take out a toner bottle 100 containing developer for forming an image. The first cover 91 has inside a toner bottle 100 and a housing 101. The toner bottle 100 can be taken out by opening the first cover 91.

The second cover 92 is placed under the first cover 91, and configured to open/close when turned around the same axis of rotation as the first cover 91. The second cover 92 is fixed to a long fixed axis in the direction of the arrow A1 and openable in the same direction of the arrow A2 as the first cover 91. The second cover 92 has inside a not-shown fixing unit and a paper sheet conveying path for image forming.

The toner bottle 100 is a container having a spiral internal circumference, and configured to supply toner from an opening when externally rotated.

A not-shown developing unit is placed behind the toner bottle 100 in the image forming apparatus. Around the toner bottle 100, the not-shown fixing unit and a charger are placed.

On the upper front side of the image forming apparatus, a control panel 93 is provided for various operations of the apparatus. The control panel 93 has a display for displaying the states of the apparatus and instructions for the user, and buttons for transmitting external instructions to a control unit. The user operates the image forming apparatus 1 by using the display and buttons.

Figure 2:
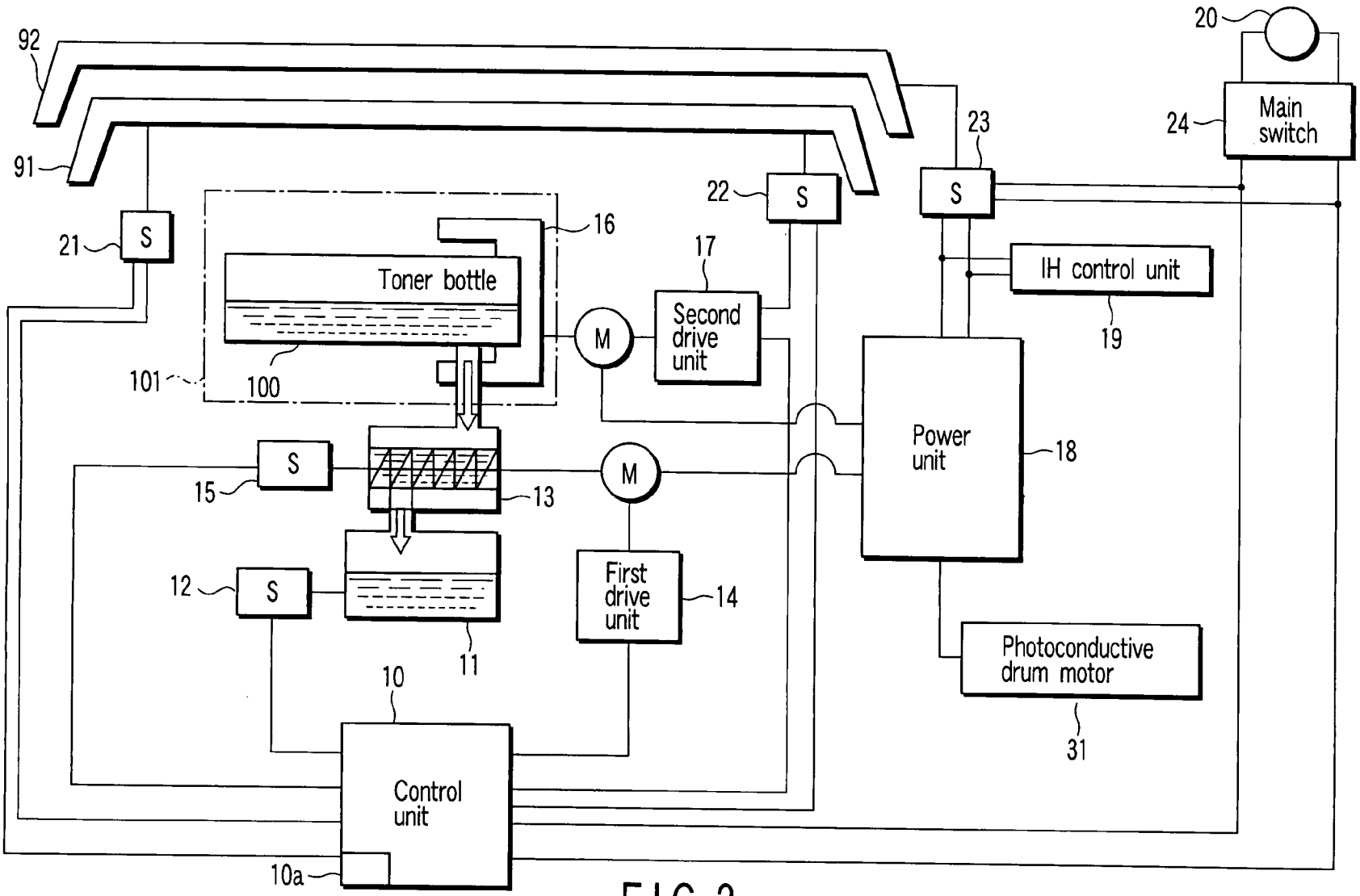
FIG. 2 is a block diagram explaining the schematic configuration of the part around an image forming unit in the image forming apparatus shown in FIG. 1.

Next, explanation will be given on the schematic configuration of the part around an image forming unit in the image forming apparatus 1 with reference to FIG. 2. FIG. 2 is a block diagram explaining the configuration of the components included in the image forming apparatus 1 shown in FIG. 1.

The image forming apparatus 1 has a control unit 10, a developing unit 11, a developing unit toner amount sensor 12, a first supply unit 13, a first drive unit 14, a first supply unit toner amount sensor 15, a second supply unit 16, a second drive unit 17, a power unit 18, an IH control circuit 19, a power supply 20, an open/close detection switch 21 as an open/close detecting means, a first interrupt switch 22 as a first interrupting means (first interrupt unit), a second interrupt switch 23 as a second interrupting means (second interrupt unit), a main switch 24, a first cover 91, a second cover 92, a toner bottle 100, and a housing 101.

The control unit 10 is connected to a counter to count the number of printed paper sheets. Detailed explanation will be given later. The control unit 10 is connected to the power supply 20 through the main switch.

The control unit 10 is connected to the developing unit toner amount sensor 12, first supply unit toner amount sensor 15, open/close detection switch 21, and first interrupt switch 22. The control unit 10 controls at least the first drive unit 14 and second drive unit 17.

The interrupt switch 22 interrupts the connection between the control unit 10 and drive unit 17 when the first cover 91 opened. In contrast, when the first cover 91 is closed, the control unit 10 and second drive unit 17 are connected, and the power from the control unit 10 can be supplied to the second drive unit 17. Namely, when the first cover 91 is opened, the interrupt switch 22 is turned off to interrupt the power from the power supply 20 supplied to the second drive unit 17 and make a non-energized state. When the first cover 91 is closed, the interrupt switch 22 is turned on to permit the supply of power from the power supply 20.

The second supply unit 16 supplies the toner contained in the toner bottle 100 to the first supply unit 13.

The first supply unit 13 supplies the toner received from the second supply unit 16 to the developing unit 11.

The developing unit 11 contains the toner supplied from the first supply unit 13, and supplies the toner to a photoconductive drum (not shown) to form a toner image. A not-shown stirring mechanism to stir the toner in the developing unit is connected to the photoconductive drum motor 31 to rotate the photoconductive drum through a specified cam mechanism, and operated as a follower.

The first drive unit 14 operates the first supply unit 13 through a motor M. The motor M is connected to the power unit 18. The first drive unit 14 cannot operate the first supply unit 13 without the power supply from the power unit 18 to the motor M.

The second drive unit 17 operates the second supply unit 16 through a motor M. The motor M is connected to the power unit 18. The second drive unit 17 cannot operate the second supply unit 16 without the power supply from the power unit 18 to the motor M. The second drive unit 17 cannot drive the motor M without a control signal from the control unit 10.

Thus, when the circuit to connect the control unit 10 and second drive unit 17 is opened by the first interrupt switch 22, the second drive unit 17 cannot drive the motor M. Therefore, when the first cover 91 is opened, toner is not supplied from the toner bottle 100 to the first supply unit 13.

The developing unit toner amount sensor 12 detects the toner amount in the developing unit 11, and informs the control unit 10 of the toner amount in the developing unit 11. When the toner amount in the developing unit 11 detected by the developing unit toner amount sensor is lower than a predetermined amount, the control unit 10 instructs the first drive unit 14 to supply the toner of the first supply unit 13 to the developing unit 11.

The first supply unit toner amount sensor 15 detects the toner amount in the first supply unit 13, and informs the connected control unit 10 of the toner amount passing through the first supply unit 13. When the toner amount in the first supply unit 13 detected by the first supply unit toner amount sensor is lower than a predetermined amount, the control unit 10 instructs the second drive unit 17 to supply the toner of the toner bottle 100 to the first supply unit 13.

The open/close detection switch 21 detects the opening/closing of the first cover 91, and informs the connected control unit 10 of the opening/closing of the first cover 91. When the opening of the first cover 91 is detected by the open/close detection switch 21, the control unit 10 makes the counter 10*a* count the number of printed paper sheets. When the counting reaches a predetermined value, the control unit 10 stops the photoconductive drum motor 31 and first drive unit 14 supplying power to the developing unit 11.

This prevents continuation of image forming operation with insufficient toner in the developing unit 11 caused by the stop of the second drive unit 17 and stop of toner supply from the toner bottle 100 to the first supply unit 13 as a result of the opening of the first cover 91. This avoids image forming with insufficient toner, and prevents a defective image with unevenness and blurring.

When the closing of the first cover 91 is detected by the open/close detection switch 21, the control unit 10 makes the counter 10*a* reset the counting of the number of printed paper sheets regardless of whether the toner bottle 100 is replaced or not.

The second interrupt switch 23 is turned on/off by the opening/closing of the second cover 92, and controls power supply to the power unit 18 and IH control unit 19 according to the opening/closing of the second cover 92. Concretely, when the second cover 92 is opened, the second interrupt switch 23 interrupts the connection between the power supply 20 and power unit 18 and between the power supply 20 and IH control unit 19. Contrarily, when the second cover 92 is closed, the switch 23 makes the connection between the power supply 20 and power unit 18 and between the power supply 20 and IH control unit 19. Thus, the power from the power supply 20 is supplied to the power unit 18 and IH control unit 19. Namely, when the second cover 92 is closed, the power from the power supply 20 to the power control unit 18 and IH control unit 19 is interrupted and the units become non-energized. When the first cover 91 is closed, the interrupt switch 22 is turned on and the power is supplied from the power supply 20 to the units. The control unit 10 and power supply 20 are not interrupted unless the main switch is turned off. Thus, even if the second cover 92 is opened, the functions of the control panel 93 can be used.

The power unit 18 is a part to transmit power to the power means incorporated in the image forming apparatus 1, and connected to the photoconductive drum motor 31 to rotate a photoconductive drum (not shown), for example.

The IH control unit 19 is a control system for an inductive heater (not shown) incorporated in a fixing unit (not shown). In this embodiment, the inductive heater supplies an exciting coil with a predetermined high frequency current. A conductive layer at the periphery of the heating roller is heated by receiving the magnetic field generated from the exciting coil. The toner supplied from the developing unit 11 to a paper sheet is fused by receiving the heat from the heating roller, and fixed to the paper sheet by receiving the pressure from the pressing roller.

The main switch 24 is placed at a position operable by the user. When the main switch is turned on, the power from the power supply 20 is supplied to the whole image forming apparatus, namely, the control unit 10, power unit 18 and IH control unit 19. When the main switch is turned off, the power from the power supply 20 is interrupted.

Therefore, according to the present invention, when the first cover 91 is opened, the first interrupt switch 22 interrupts power supply to the second drive unit 17. Thus, the toner bottle 100 is not rotated, and the operator can take out the toner bottle 100 safely. Even when the first cover 91 is opened, the first drive unit 14 is operated by the control unit 10 and the first supply unit 13 can supply toner to the developing unit 11. Further, even when the first cover 91 is opened, the photoconductive drum motor 31 is rotated by the power unit 18. Therefore, the stirring member in the developing unit 11 is operated, and the developing unit 11 can supply toner to the photoconductive drum and form a toner image.

As described above, the first cover 91 according to this embodiment is configured to be openable for replacing the toner bottle 100. Even when the first cover 91 is opened, the developing operation by the developing unit 11 is not stopped and can be continued.

When the first cover 91 is opened, the open/close detection switch 21 detects the opening of the first cover 91, and the counter 10*a* counts the number of paper sheets printed after the stop of toner supply from the toner bottle 100. Therefore, an extended period of developing operation under the stop of toner supply from the toner bottle 100 is prevented. This avoids image forming with insufficient toner, and prevents defective image with uneven thickness and blurring.

Further, when the second cover 92 is opened, the second interrupt switch 23 interrupts power supply to the power unit 18 and IH control unit 19. Namely, the inductive heating by the IG control unit 19 is stopped, and the motor connected to the power unit 18 is stopped. Thus, even if the cover 92 is opened and the motor and IH control unit 19 provided inside are exposed, the user is protected from touching these inside units and can safely use the image forming apparatus.

In this embodiment, the power unit 18 is connected also to the members other than the photoconductive drum motor 31, for example, a not-shown developing unit fan motor, a reverse motor, a paper eject motor, a high-voltage developing device, an IH fan motor, a fixing unit motor, and a transfer belt motor. Thus, even when the second cover 92 is opened and the charger (not shown) is exposed, the connection between the power unit 18 and power supply 20 is interrupted, and power supply to the high-voltage developing device that executes charging of the charger is also interrupted. Therefore, the user can safely use the image forming apparatus.

The image forming apparatus 1 shown in FIG. 1 has a scanner for supplying optically read image information to an image forming unit. An operating part of the scanner is also connected to the power unit 18. For example, a scanning motor may be connected to the power unit 18. Further, in the above description, the power unit 18 is connected to the operating part of the unit incorporated in the image forming apparatus 1. However, the present invention is not limited to this configuration. A part of control system, for example, a scanning motor control circuit may be connected.

In this embodiment, a predetermined number of printed paper sheets counted by the counter 10*a* under the control of the control unit 10 is 100 sheets. It is permitted to change the predetermined number by setting 100 to 2000 sheets in units of 100 sheets from the control panel 93 as a setting unit. The setting unit may be connected to an external controller (not shown) such as a personal computer. A predetermined value may be entered from the external controller.

Embodiment 1

Figure 3:
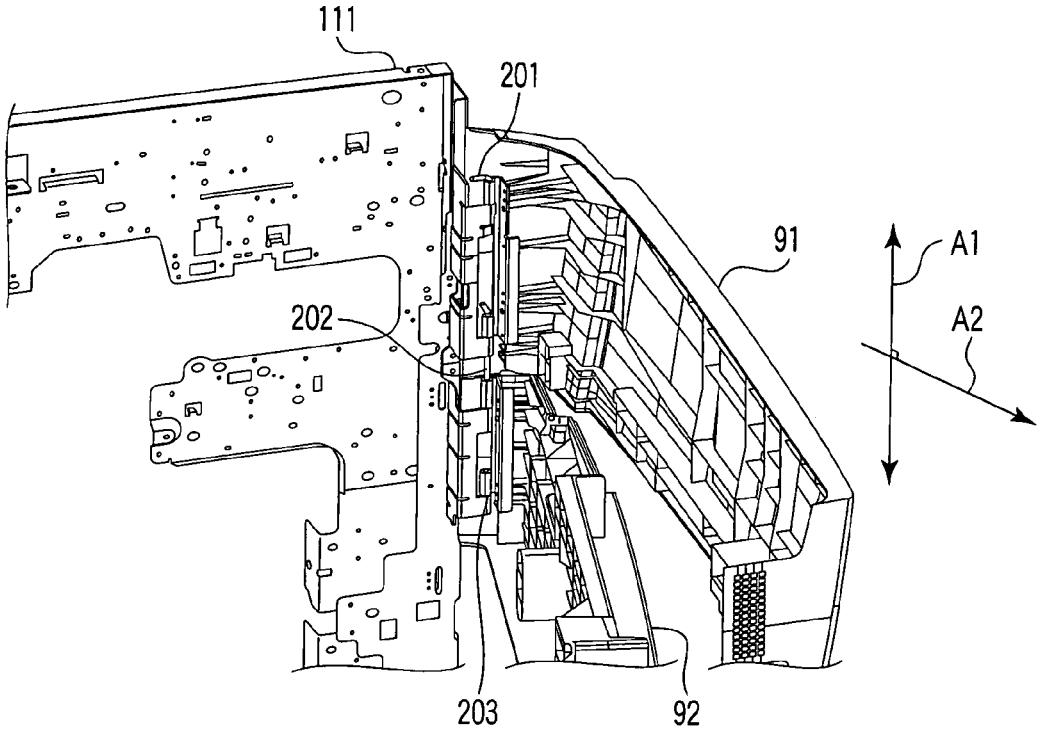
FIG. 3 is a schematic perspective view showing the fixing parts of each cover provided in the image forming apparatus shown in FIG. 1.
Figure 4:
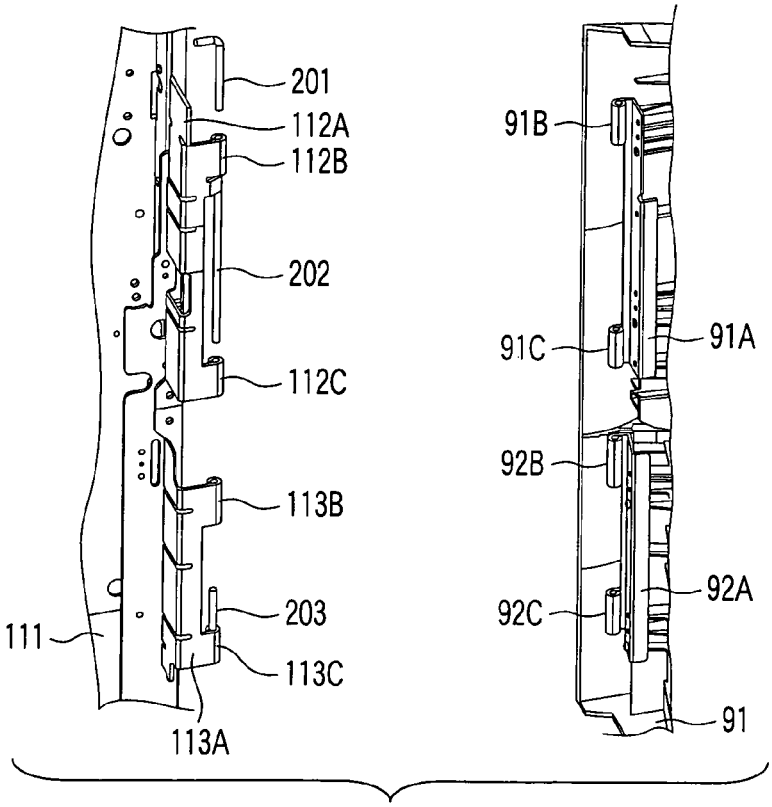
FIG. 4 is a schematic perspective view of the covers shown in FIG. 3 before being fixed.
Figure 5:
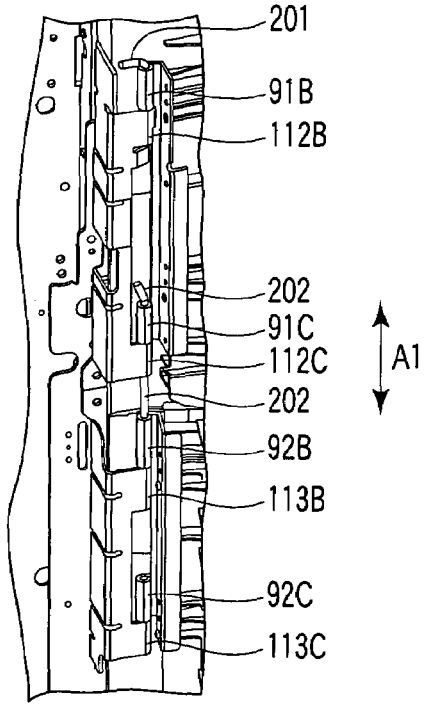
FIG. 5 is a magnified view of the fixing parts shown in FIG. 3.

An embodiment of the present invention will be explained hereinafter with reference to FIGS. 3-5. FIG. 3 is a schematic perspective view showing the fixing parts of the first cover 91 and second cover 92 fixed openably to the main body frame 111. FIG. 4 is a schematic perspective view of the first cover 91 and second cover 92 before being fixed to the main body frame 111. FIG. 5 is a schematic perspective view of the first cover 91 and second cover 92 after being fixed to the main body frame 111. Namely, FIG. 5 is a magnified view of the fixing parts shown in FIG. 3.

As shown in FIG. 3, the first cover 91 and second cover 92 are fixed openably to a part of the main body frame 111 of the image forming apparatus 1 through the fixed axes 201, 202 and 203. The fixed axis 201 fixes the first cover 91 to the main body frame 111. The fixed axis 203 fixes the second cover 92 to the main body frame 111. The fixed axis 202 serves as a common fixed axis to fix the first cover 91 and second cover 92 to the main body frame 111 in the seam between the first cover 91 and second cover 92.

As shown in FIG. 4, the first cover 91 has a connecting member 91A, and the second cover 92 has a connecting member 92A. The connecting member 91A has a cover side fixing bearing 91B at one end in a first direction indicated by the arrow A1 in FIG. 3, and a cover side fixing bearing 91C at the other end. The connecting member 92A has a cover side fixing bearing 92B at one end in a second direction, and a cover side fixing bearing 92C at the other end.

The main body frame 111 has a connecting member 112A connected to the connecting member 91A of the first cover 91, and a connecting member 113A connected to the connecting member 92A of the second cover 92. The connecting member 112A has a frame side fixing bearing 112B at one end in a first direction, and a frame side fixing bearing 112C at the other end. The connecting member 113A has a frame side fixing bearing 113B at one end in a first direction, and a frame side fixing bearing 113C at the other end.

These fixing bearings 91B, 91C, 92B, 92C, 112B, 112C, 113B and 113C have a hole to insert a fixed axis long in the first direction and represented by the fixed axes 201, 202 and 203.

As shown in FIG. 5, the fixed axis 201 is positioned across the cover side fixing bearing 91B and frame side fixing bearing 112B adjacent in the first direction A1, and fixes the first cover 91 openably to the main body frame 111. The fixed axis 201 is a removable fixed axis, and has a long part having the length penetrating the cover side fixing bearing 91B and frame side fixing bearing 112B adjacent as shown in FIG. 4, and a short part provided at one end of this and bent in a direction different to the long part. The fixed axis 201 is inserted from the cover side fixing bearing 91B up to the frame side fixing bearing member 112B, and fixes the first cover 91 to the main body frame 111 in the state suspended under gravity caused by that the short part hangs on the cover side fixing bearing 91B.

The fixed axis 202 fixes the first cover 91 and second cover 92 openably to the main body frame 111. Concretely, as shown in FIG. 5, the fixed axis is positioned across the cover side fixing bearing 91C and frame side fixing bearing 112C adjacent in the second direction A2, and across the cover side fixed axis 91B and frame side fixing bearing 112B adjacent in the first direction A1.

The fixed axis 202 is a removable fixed axis as the fixed axis 201, and has a long part having the length penetrating the cover side fixing bearing 91C and frame side fixing bearing 113B, and a short part provided at one end of this and bent in a direction different from the long part. The fixed axis 202 is inserted from the cover side fixing bearing 91C located at the top up to the frame side fixing bearing 113B, and fixes the first cover 91 and second cover 92 to the main body frame 111 in the state suspending by gravitation caused by that the short part hangs on the cover side fixing bearing 91C.

The fixed axis 203 is positioned across the cover side fixing bearing 92C and frame side fixing bearing 113C adjacent in the second direction A2, as shown in FIG. 5, and fixes the second cover 92 openably to the main body frame 111. The fixed axis 203 is fixed to the frame side fixing bearing 113C just like projecting upward by a predetermined length, as shown in FIG. 4. The cover side fixing bearing 92C is fit over the projected pin portion of the fixed axis 203, thereby the second cover 92 is fixed to the main body frame 111.

Therefore, when fixing the first cover 91 and second cover 92 to the main body frame 111, insert the cover side fixing bearing 92C of the second cover 92 onto the fixed axis 203 and fix the lower connecting part of the second cover to the main body frame 111. Then, place the connecting member 91A of the first cover 91 at the position corresponding to the connecting member 112A of the main body frame 111, and fix the first cover 91 and second cover 92 by using the fixed axis 201 or 202.

Concretely, place the cover side fixing bearing 91B and frame side fixing bearing 112B side by side, insert the fixed axis 201 from the cover side fixing bearing 91B, and fix the upper connecting part of the first cover 91 to the main body frame 111. Then, the first cover 91 and second cover 92 are temporarily fixed to the main body frame 111.

The lower connecting part of the first cover 91 and upper connecting part of the second cover 92 are placed at the position corresponding to the main body frame 111 in this state, and can be fixed to the main body frame 111 by inserting the fixed axis 202 into the cover side fixing bearing 91C. Then, the first cover 91 and second cover 92 are firmly fixed to the main body frame 111.

The first cover 91 and second cover 92 are fixed by the same fixed axis 202 as described above. In other words, the first cover 91 and second cover 92 have the same-phase fixed axis.

Therefore, there is no displacement in the seam between the first cover 91 and second cover 92, and the cover area placed with the same phase by the fixed axis 202. This solves the problem of decreasing the cover fixing strength when the covers are repeatedly opened and closed. The covers can be stably opened and closed.

Further, as described above, the fixed axis 203 has been previously fixed to the frame side fixing bearing of the main body frame 111. Therefore, the second cover 92 can be temporarily fixed with ease simply by fitting the cover side fixing bearing 92C to the fixed axis 203. In this embodiment, the fixed axis 203 is fixed firmly to the frame side fixing bearing 113C by tightening furthermore.

However, when fitting the fixed axis 203, space is required to slide the second cover 92 in the direction of the arrow A1. Therefore, various covers can be fixed according to the structure of the apparatus by combining a removable fixed axis such as the fixed axis 201 with a fixed axis such as the fixed axis 203.

As described above, the fixed axis 202 is a removable fixed axis used commonly for the first cover 91 and second cover 92. Therefore, two or more covers can be easily fixed to a common fixed axis.

In this embodiment, the first cover 91 and second cover 92 are fixed to the main body frame 111 in the vertical direction (refer to the arrow A1 in FIG. 1) of the image forming apparatus 1. The present invention is not limited to this configuration. A common fixed axis may be fixed to the image forming apparatus 1 to open and close each cover in the same direction. The directions of placing and opening/closing the covers are not a matter. Therefore, each cover 91 and 92 may be fixed in the horizontal direction, for example, of the image forming apparatus 1.

In this embodiment, three fixed axes 201, 202 and 203 are used as described above. The present invention is not limited to this configuration. For example, the frames 91 and 92 may be fixed with one fixed axis (not shown) having the functions of the fixed axes 201, 202 and 203 and having the length from the cover side fixing bearing 91B to the frame side fixing bearing 113C. Instead of the fixed axes 201 and 202, one fixed axis (not shown) having the length from the cover side fixing bearing 91B to the frame side fixing bearing 113B may be used.

Embodiment 2

Figure 6:
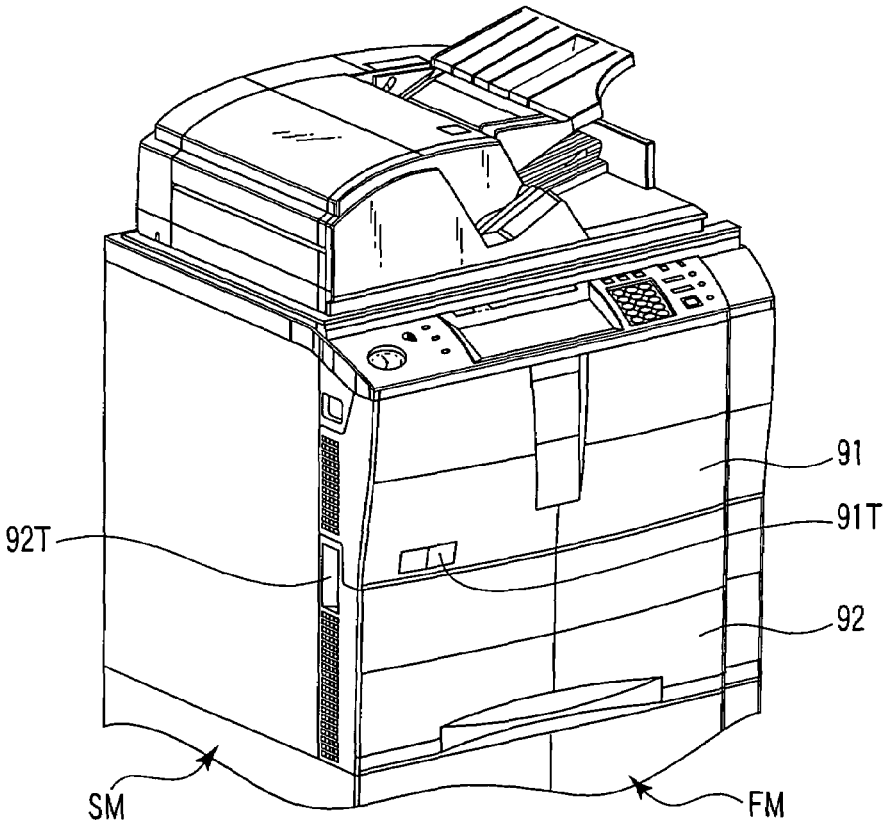
FIG. 6 is a schematic perspective view showing the image forming apparatus shown in FIG. 1, with the covers closed.
Figure 7:
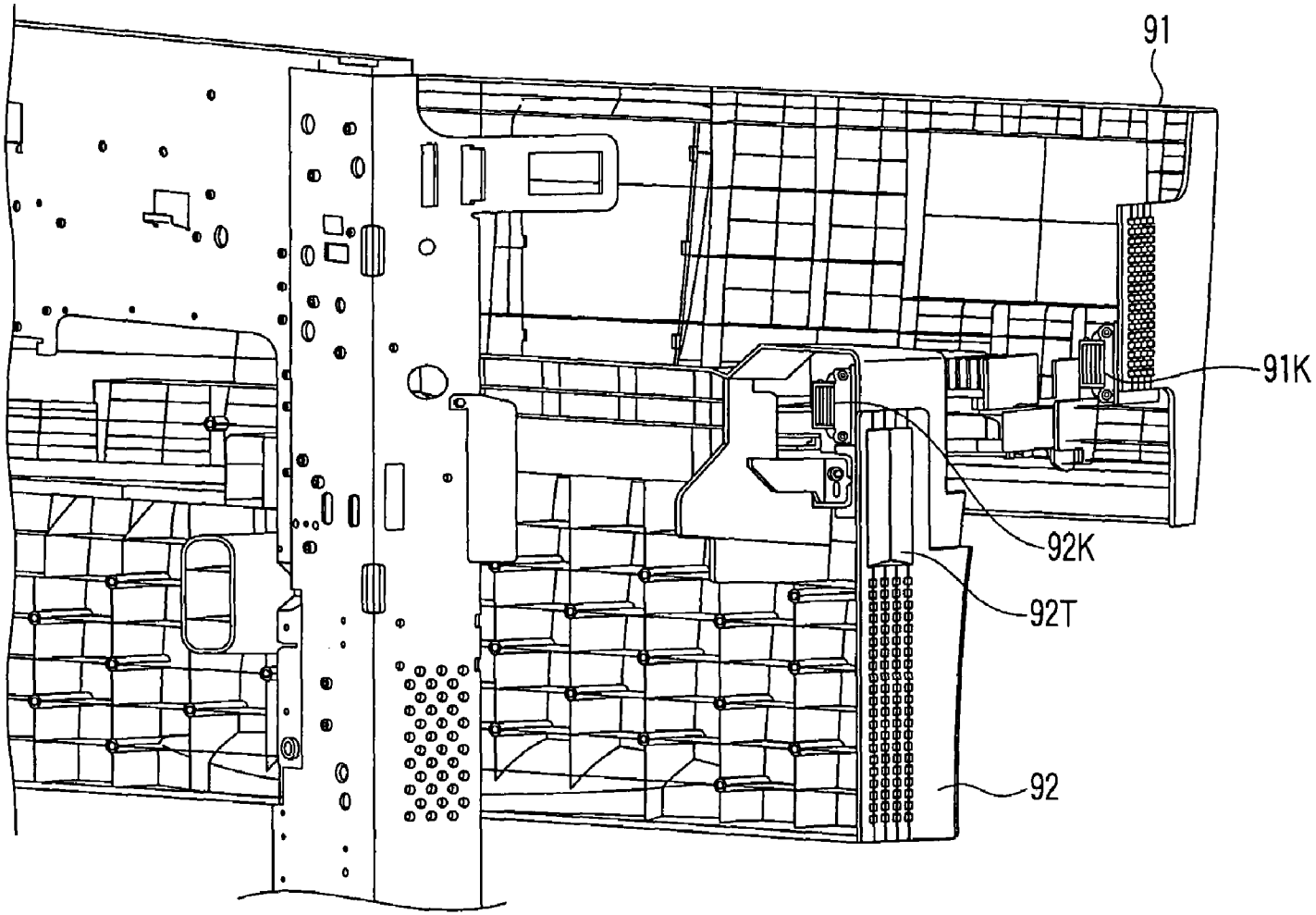
FIG. 7 is a schematic diagram viewed from the inside of the construction of the connecting members of each cover of the image forming apparatus shown in FIG. 1, with the covers opened.

Next, a second embodiment of the present invention will be explained with reference to FIGS. 6 and 7. FIG. 6 is a schematic perspective view showing the image forming apparatus 1 with the first cover 91 and second cover 92 shown in FIG. 1 closed. FIG. 7 is a schematic diagram viewed from the inside of the construction of the connecting members of each cover with the first cover 91 and second cover 92 opened.

As shown in FIG. 6, the first cover 91 has a knob 91T provided on the front side FM of the image forming apparatus 1, and the second cover 92 has a knob 92T provided on the side SM of the image forming apparatus 1. Namely, the knob 91T of the first cover 91 located on the front side of the image forming apparatus 1 is found easily by the user, and the knob 92T of the second cover 92 located on the side of the image forming apparatus 1 is not easily found by the user.

The knob 91T is placed at the same height as the knob 92T in the vertical direction. In other words, the knobs 91T and 92T have an area (overlapped area) overlapped on the same horizontal line of the image forming apparatus 1.

Explained in detail, the second cover 92 is formed convex, so that a part of the side SM with the knob 92T bites in a part of the side SM of the first cover 91. A part of the side SM of the first cover 91 is formed concave to meet the convex of the second cover 91. The first cover 91 and second cover 92 have an overlapped area overlapping each other in the horizontal direction of the image forming apparatus 1.

At least a part of the knobs 91T and 92T is placed in the overlapped area, and the knobs have an overlapped part in the horizontal direction of the image forming apparatus 1. In other words, the knobs 91T and 92T are placed with the same phase in the horizontal direction of the image forming apparatus 1.

The knobs 91T and 92T of the first and second covers 91 and 92 are formed on the different sides of the image forming apparatus 1. Therefore, the operability when opening the first cover 91 or second cover 92 can be given variations. The knob 92T of the second cove 92 is provided at a position hard to be found by the operator, compared with the knob 91T of the first cover 91. Therefore, the operability of opening and closing the first and second covers 91 and 92 becomes easy, and the possibility of opening the second cover 92 mistaken for the first cover 91 is decreased, preventing the opening of a wrong cover by the user.

Explanation will now be given on the connecting parts of the first cover 91 and second cover 92 with reference to FIG. 7.

As shown in FIG. 7, the first cover 91 has a connecting member 91K, and the second cover 92 has a connecting member 92K.

The connecting member 91K is provided at the same height as the knob 91T of the first cover 91 in the vertical direction. In other words, the connecting member 91K is placed at the position with the same phase as the knob 91T of the first cover 91 in the horizontal direction of the image forming apparatus 1. The connecting member 91K and knob 91T have an overlapped area overlapping on the same horizontal line. In this embodiment, the connecting member 91K is provided on the back of the knob 91T of the first cover 91. The connecting member 91K is composed of a magnet, for example, and can connect the first cover 91 and second cover 92.

The connecting member 92K is provided at the same height as the knob 92T of the second cover 92 in the vertical direction. In other words, the connecting member 92K is placed at the position with the same phase as the knob 92T of the second cover 92 in the horizontal direction of the image forming apparatus 1. The connecting member 92K and knob 92T has an overlapped area overlapping on the same horizontal line. In this embodiment, the connecting member 92K is provided on the back of the knob 92T of the second cover 92. The connecting member 92K is composed of a magnet, for example, and can connect the second cover 92 and main body frame 111.

As described above, the connecting member 91K and knob 91T provided on the first cover 91 are placed at the same height in the vertical direction. Namely, the connecting member 91K and knob 91T are placed on the same line in the direction (horizontal direction) orthogonal to the direction (vertical direction) where the first cover 91 is fixed to the main body frame 111 through the fixed axis. Therefore, when the knob 91T is pulled in the opening/closing direction in order to open the first cover 91, a stress of a horizontal direction is applied across the connecting member 91K and knob 91T, and becomes identical to the horizontal direction or the direction of opening/closing the first cover 91. This enables stable opening/closing of the cover.

If the knob and connecting member are displaced in the height of in the vertical direction, a tensile force of a direction different from the horizontal direction is applied across the fixing member and knob, and a torsional stress (hereinafter called a rotating force) is applied to the fixing member and the cover may be warped. Further, if the cover is made of thin resin, the cover may be damaged when pulled strongly. The other connecting members may be removed by the rotating force. For example, when the first cover is connected to the second cover as in this embodiment, if the first cover is pulled in order to open it, the rotating force is generated and the second cover may be opened together.

Therefore, the first cover 91 is prevented from warping and deforming when opening and closing, by placing the connecting member 91K and knob 91T at the positions on the same line in the horizontal direction, that is, placing the connecting member 91K and knob 91T at the position on the same plane as the opening/closing direction, as described above. The damage of the first cover 91 caused by the opening/closing operation or the releasing the connection of the connecting member 91K can be decreased. This is particularly effective when the cover is made of thin resin in order to make the apparatus lightweight.

Further, the first cover 91 is connected to the second cover 92 through the connecting member 91K, and the first cover is opened together when the second cover 92 is opened, as described above. The connecting member 91K of the first cover 91 is weak in the connecting force compared with the connecting member 92K of the second cover 92. Namely, the stress required to open the first cover 91 is smaller than the stress required to open the second cover 92. Even if the knob 91T is pulled by the user to open the first cover 91, the connecting member 92K of the second cover 92 is held connected to the main body frame 111 by the stronger connecting force. Therefore, the connecting member 92K of the second cover 92 is not separated from the main body frame 111 by the stress applied when the first cover 91 is opened, and accidental opening of the second cover 92 can be prevented.

In this embodiment, magnets with different magnetic forces are used for the connecting members 91K and 92K, and the magnetic force of the magnet of the connecting member 91K is weaker than that of the magnet of the connecting member 92K.

Further, the connecting members 91K and 92K and knobs 91T and 92T can be placed at the positions of the same height in the vertical direction, by providing the connecting members 91K and 92K and knobs 91T and 92T of the first and second covers 91 and 92 at the same height in the vertical direction and by placing the knobs 91T of the first cover 91 and knob 92T of the second cover 92 at the same height in the vertical direction, as in this embodiment. Namely, the connecting member 91K, 92K and knobs 91T and 92T are placed close to each other, and not separated in the vertical direction. If the connecting member of the second cover and the knob of the first cover connected to the second cover are separated in the vertical direction as in this embodiment, the stress applied to open the first cover acts as a rotating force on the knob of the second cover, and the connecting member of the second cover is separated, and the second cover may be opened.

The rotating force is controlled and the stable opening/closing of the first and second covers 92 is possible, by placing the connecting members 91K and 92K and knobs 91T and 92T at the same height in the vertical direction, as in this embodiment.

The first cover 91 is provided openably to replace the toner bottle 100. As explained with reference to FIG. 2, the toner supply from the toner bottle 100 is stopped when the first cover 91 is opened, and developing operation of the developing unit 11 is stopped when the second cover 92 is opened. Therefore, by making the connecting force of the connecting member 91K smaller than the connecting force of the connecting member 92K, the second cover 92 is not accidentally opened when the first cover 91 is opened, and accidental stopping of the image forming apparatus 1 can be prevented.

In addition, the connecting member 91K and knob 91T are provided at the same height in the vertical direction, and knobs 91T and 92T are placed at the same height in the vertical direction in the present invention. Therefore, a stress including a rotating force is not applied to the second cover 92 when the cover 91 is opened by pulling the knob 91T, and accidental opening of the cover 92 can be prevented.

As the open/close detection switch 95 explained in FIG. 2, for example an optical sensor may be used, and it may respond to the movement of the first cover 91 caused by warping and deforming. In this embodiment, the open/close detection switch 95 is placed at the same height as the connecting members 91K and 92K and knobs 91T and 92T in the vertical direction. Since the first and second covers 91 and 92 are overlapped in the straight line direction (horizontal direction) on the same plane as the opening/closing direction in this embodiment, warping of the covers by stress is prevented. This prevents mis-detection of the opening/closing of the first cover 91 caused by the warping.

Further, as shown in FIG. 6, the knobs 91T and 92T are preferably placed at substantially the center when viewed as one unit together with the first and second covers 91 and 92. Therefore, the knob 91T is placed in the lower part of the first cover 91, and the knob 92T is placed in the upper part of the second cover 92.

Embodiment 3

Figure 8:
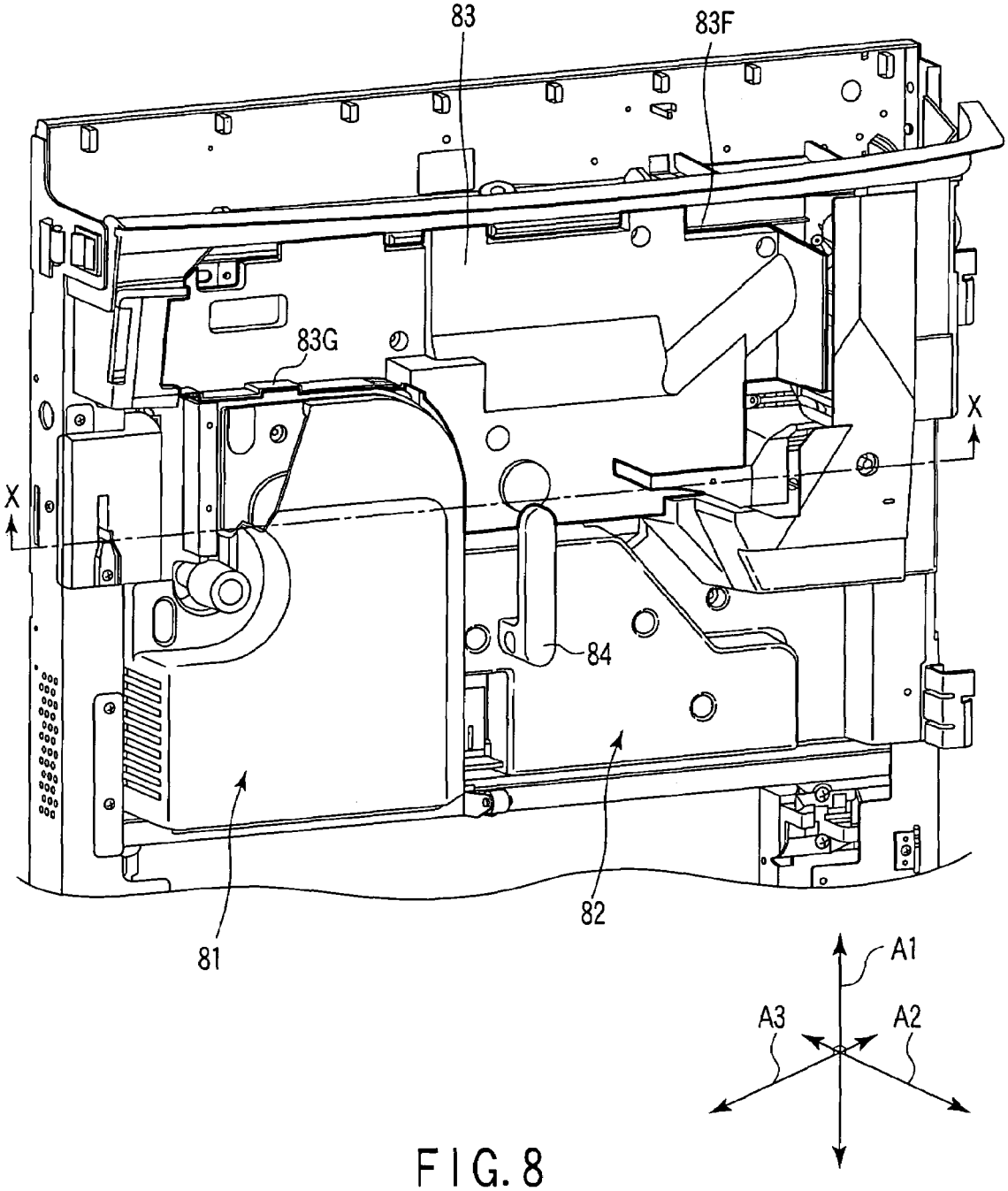
Figure 9:
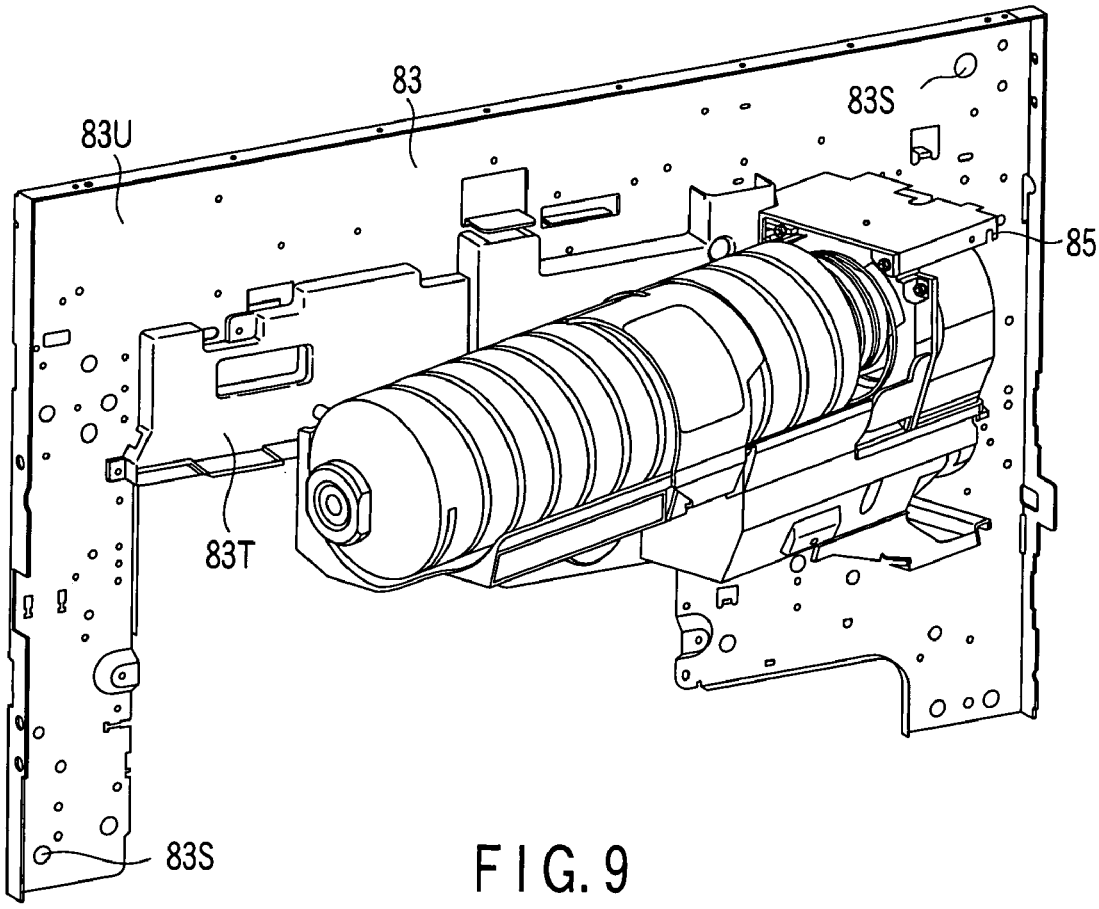
FIG. 9 is a schematic perspective view showing the protection cover and toner bottle case shown in FIG. 8.
Figure 10:
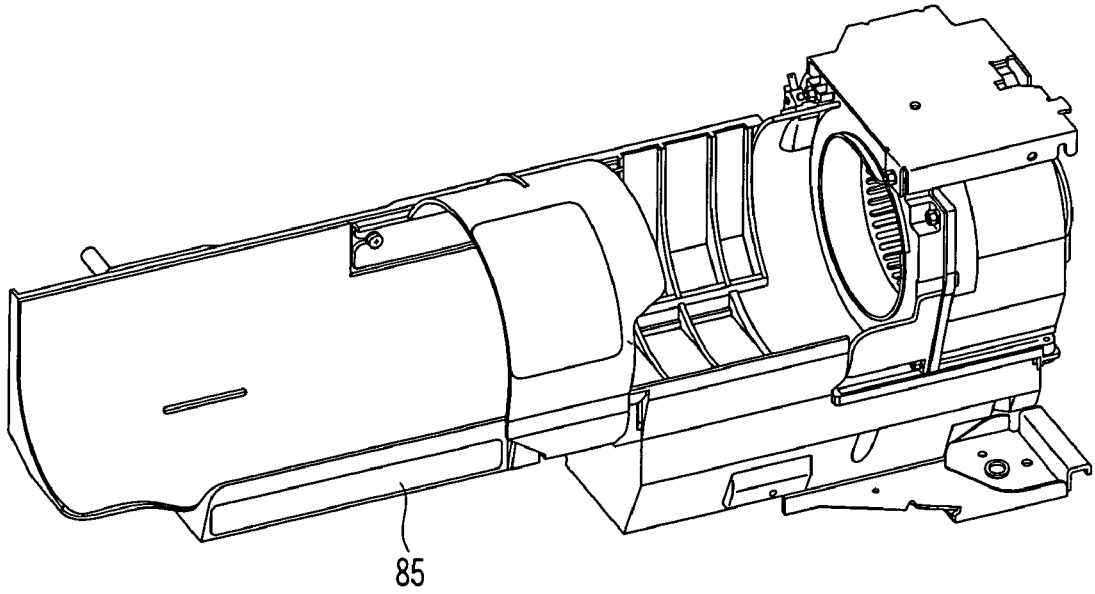
FIG. 10 is a schematic perspective view showing the toner bottle case shown in FIG. 9.
Figure 11:
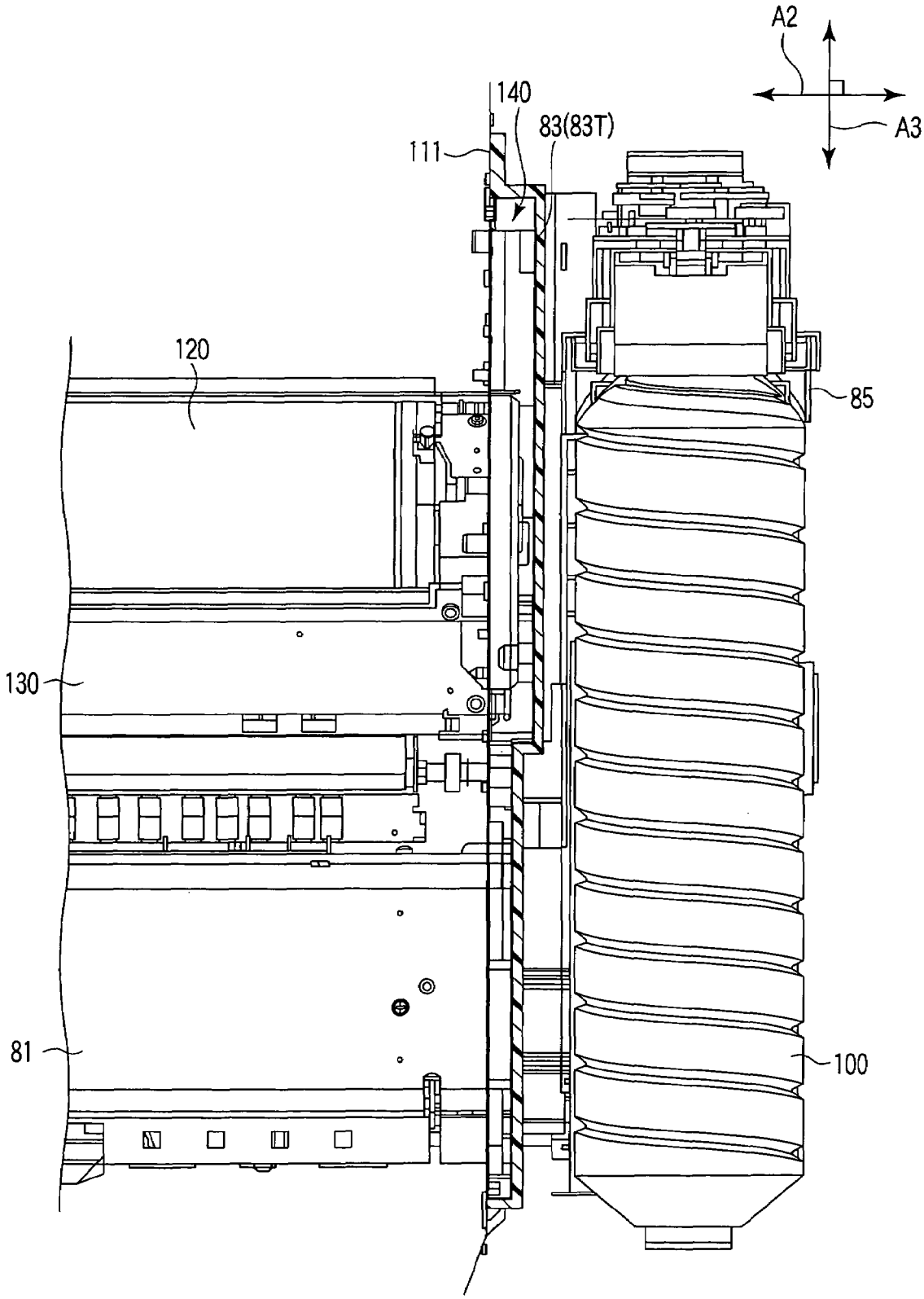
FIG. 11 is a schematic perspective view of the image forming apparatus shown in FIG. 1, cut horizontally and viewed from the top.

Next, a third embodiment of the present invention will be explained with reference to FIGS. 8-11. FIG. 8 is a schematic perspective viewed from the front side FM of the image forming apparatus 1 with the first and second covers 91 and 92 removed. FIG. 9 a schematic perspective view of a toner bottle case, which contains the protection cover and toner bottle 100 shown in FIG. 8. FIG. 10 is a schematic perspective view of the toner bottle case shown in FIG. 9. FIG. 11 a schematic perspective view of the image forming apparatus 1 cut horizontally and viewed from the top.

As shown in FIGS. 8 and 9, the image forming apparatus 1 has a fixing unit 81, a conveying means 82 to convey a paper sheet as an image forming medium, and a protection cover 83 to cover other internal units provided in the image forming apparatus 1, in the area exposed when the first and second covers 91 and 92 are removed.

The fixing unit 81 and conveying means 82 are placed in the lower area covered by the second cover 92. The fixing unit 81 and conveying means 82 are preferably configured as one unit to be drawn out through a lever 84 in the direction of the arrow A2.

The protection cover 83 consists of one plate-like member including at least an area 83F enclosed by the thick line in FIG. 8, and has functions of electrical insulation, heat insulation and light shielding to be explained in detail below. In this embodiment, the protection cover 83 having the size shown in FIG. 9 is used. Namely, the periphery coincides with the periphery of the main body frame 111 (FIG. 1) to cover the whole image forming apparatus 1, in the part not only the area 83F corresponding to the toner bottle 100 but also the front side FM of the image forming apparatus 1, excluding the area corresponding to the fixing unit 81 and conveying means 82. FIG. 8 shows the state that other component members are placed on the protection cover 83 (outside of the apparatus). The protection cover 83 covers the area exposed when at least the first and second covers 91 and 92 are removed.

The protection cover 83 is made of plate-like material such as resin having an insulating property, and has a three-dimensional structure formed with convexes and concaves, as shown in FIG. 9. Explained in detail, the protection cover 83 has a convex area 83T projecting to the outside in the area close at least to the toner bottle 100, for example, the area 83F indicated by the thick line in FIG. 8, and a concave area 83U formed in the other area. The protection cover 83 is fixed to the main body frame 111 by a predetermined fixing member (e.g., a screw) by a line or at a point through the connecting parts 83S formed mainly on the concave area 83U. In other words, the protection cover 83 does not include the area with the whole surface made contact with the main body frame 111 or the other internal units provided in the image forming apparatus 1I, in the state fixed to the main body frame 111.

Therefore, as shown in FIG. 11, an air layer 140 is formed between the convex area 83T of the protection cover 83 and main body frame 111.

The protection cover 83 is fixed to the front side FM of the main body frame 111 along the toner bottle 100. A toner bottle case (holding unit) 85 to hold the toner bottle 100 is provided on the outside of the protection cover 83.

As shown in FIG. 10, the toner bottle case 85 is provided not to move the cylindrical toner bottle 100, and shaped to have curved surfaces adjusted to the shape of the toner bottle 100, and placed between the toner bottle 100 and protection cover 83.

The protection cover 83 has inside a photoconductive drum 120, a charger 130, and a fixing unit 81, as shown in FIG. 11.

The protection cover 83 is configured to cover the inside from the toner bottle 100 of the image forming apparatus 1. Therefore, as explained above, even if the first cover 91 is opened to replace the toner bottle 100 during the developing operation, the inside units such as the charger 130 or transfer unit (not shown) using high voltage and the driving mechanism (not shown) driven by a motor, are not exposed. The user can avoid injury by touching these inside units, and safely use the image forming apparatus. The protection cover 83 is made of insulating material, and even if the user accidentally touches the protection cover 83, the user is not exposed to a danger of electric shock. The protection cover 83 has a function of electric insulation as described above.

Now, explanation will be give on the positional relationship among the component units with reference to FIG. 11.

As shown in FIG. 11, the protection cover 83 is placed between the toner bottle case 85 and the main body frame containing the photoconductive drum 120, charge 130 and fixing unit 81 provided inside the image forming apparatus 1. The photoconductive drum 120, charger 130 are placed, so that the longitudinal directions (the arrow A2) orthogonal to the paper sheet conveying direction indicated by the arrow A3. The toner bottle 100 is placed, so that the longitudinal direction becomes parallel to the paper conveying direction A3. Namely, the longitudinal direction (the arrow A3) of the toner bottle 100 crosses with the axial direction (the arrow A2) of the photoconductive drum 120. Therefore, the toner bottle 100 is placed close to one end of the inside units such as the photoconductive drum 120, charger 130 and fixing unit 81.

The toner bottle 100 and toner bottle case 85 are placed in the upper side from the dotted line XX shown in FIG. 8, that is, the part covered by the first cover 91. Therefore, as the fixing unit 81 and toner bottle 100 are partially overlapped in the direction of the arrow A2, the fixing unit 81 and toner bottle 100 are placed close to each other.

The protection cover 83 projects in the horizontal direction (the arrow A2) at the position close to the fixing unit 81, and has a heat insulation guide 83G placed between the fixing unit 81 and toner bottle 100 (toner bottle case 85). (Refer to FIG. 8.) The heat insulation guide 83G has a function of preventing the heat from the fixing unit 81 from flowing positively to the toner bottle 100, and has also a function of preventing radiation of heat from the fixing unit 81. This avoids a problem of fusing the toner contained in the toner bottle 100 by the heat generated from the fixing unit 81 while the fixing unit 81 is performing the fixing operation. This prevents a temperature decrease in the fixing unit 81 caused by that the first cover 91 is opened and closed for replacing the toner bottle 100 and the heat in the fixing unit 81 is radiated to the outside while the fixing unit 81 is performing the fixing operation. Therefore, the temperature in the fixing unit 81 can be held constant, and a stable fixing operation can be realized, and good image forming can be achieved. This is the heat insulating function of the protection cover 83.

The protection cover 83 has the air layer 140 formed between the convex area 83T and main body frame 111, as described above. The toner bottle 100 is held in the toner bottle case 85 fixed to the protection cover 83. The air layer 140, protection cover 83 and toner bottle case 85 are placed between the toner bottle 100 and main body frame 111. Therefore, the toner contained in the toner bottle 100 is not fused by the heat radiated from the inside units such as the charger 130 and fixing unit 81 provided in the main body frame 111. This is the heat insulating function of the protection cover 83.

Further, the protection cover 83 covers the photoconductive drum 120. Namely, the protection cover 83 has a light shielding function, and prevents reception of a wrong optical signal when the first cover 91 or second cover 92 is opened and the photoconductive drum 120 is exposed to light. This is the light shielding function of the protection cover 83.

The present invention is not limited to the embodiments explained above. The invention may be embodied in other specific forms by changing, combining or modifying without departing from its spirit or essential characteristics. The embodiments may be appropriately combined as far as possible, and the combined effect will be obtained. The embodiments include the invention in various steps, and various invention may be extracted by combining appropriate components disclosed here. For example, even if some components are deleted from the components shown in the embodiments, the problem to be solved by the invention can be solved. If the effect of the invention can be obtained, the configuration obtained by deleting some components may be extracted as invention.

Therefore, as explained in the first embodiment, the present invention prevents displacement of the seam of covers by utilizing a fixed axis provided across the seals of covers. The cover removability is improved by combining a fixed axis and a removable fixed axis according to the apparatus structure.

In the second embodiment, the connecting members 91K and 92K of the present invention are composed of magnets. The present invention is not limited to this. It is permitted to configure to hold a mating member by utilizing the force of rubber, spring or deformed elastic material to return to the original state.

In the embodiment of the present invention, the connecting part between the first cover 91 and main body frame 111 and the connecting part between the second cover 92 and main body frame 111 are connected by the fixed axis 202 that is a common fixed axis. The invention is not limited to this configuration. At least two or more covers may be fixed by using the same fixed axis. For example, when there are first, second and third covers fixed openably in the horizontal direction, the first and second covers may be fixed by a common fixed axis $\alpha$ (not shown), and the second and third covers are fixed by another common fixed axis $\beta$ (not shown).

In this embodiment, since the toner bottle 100 is provided in the lateral direction in the image forming apparatus 1 as shown in FIG. 1, the first cover 91 has the same width as the front side FM of the image forming apparatus. The present invention is not limited to this configuration. Any size of cover can be used. For example, in an image forming apparatus having a toner bottle provided in the depth direction, a first cover may have the size to take out a toner bottle from a part of the front side of the apparatus.

In the third embodiment, the protection cover 83 is explained to have the size to cover the parts exposed when the first and second covers 91 and 92 are opened, except the fixing unit 81 and conveying means 82. The present invention is not limited to this configuration. For example, when the same shape protection cover 83 is used in an image forming apparatus with the similar structure and there is a part not covered by the protection cover 83, the other members may be provided outside the protection cover 83 thereby filling the gap.

As an application of this embodiment (the first interrupt switch 22 in FIG. 2 is omitted, and the second drive unit 17 and control unit 10 are always connected. Not shown), the first interrupt switch 22 as an interrupting means operated by the opening closing of the first cover 91 may be omitted. Namely, in this application that the first interrupt switch 22 to stop and control the second drive unit 17 is omitted, when the open/close detection switch 21 detects the opening of the first cover 91, the control unit 10 controls the first drive unit 14 and developing unit 11 operable, and stops the second drive unit 17. Thus, when the first cover 91 is opened to take out the toner bottle 100, the second drive unit 17 is stopped and the toner supply from the second supply unit 16 is stopped. In this time, the toner is not supplied from the toner bottle 100 to the downstream, and the operator can take out the toner bottle 100 from the image forming apparatus.

In the above configuration, while the cover open/close detecting means detects the opening of the cover that is provided openably and covers the image forming member containing means, the control unit counts the number of printed paper sheets. When the counted number of printed paper sheets is smaller than a predetermined value, the control unit stops the supply unit which supplies the image forming member contained in the image forming member containing means to the downstream, controls the developing unit operable, and controls the image forming apparatus printable. When the counted number of printed paper sheets is equal to a predetermined value, the control unit can stop printing in the image forming apparatus.

In this embodiment, the toner bottle as an image forming member containing means is of the type having a spiral internal circumference to convey toner and not having a second supply unit. However, a toner bottle may have a conveying member as a second supply unit.

A toner cartridge (or a toner hopper) of the type having or not having a conveying member as a second supply unit may also be used.

The cover open/close unit according to the above embodiment has a first cover rotated to open/close, a second cover rotated on the same rotating axis as the first cover, and a common fixed axis provided on the rotating axis to fix the first and second covers rotatably to a fixing body.

The common fixed axis may be a removable fixed axis.

The cover open/close unit may have further a first connecting member to connect the first and second covers, and a second connecting member to connect the second cover and fixing body. The connecting force of the first connecting member may be smaller than the connecting force of the second connecting member.

At least one of the first and second connecting members may include a magnet.

The image forming apparatus according to the above embodiment is an image forming apparatus which transfers the developer supplied from a developing unit to a transfer medium, and fuse and fixes the developer to form an image on the transfer medium, comprising a first cover rotated to open/close for replacing a container containing the developer, a second cover rotated to open/close on the same rotating axis as the first cover, a common fixed axis to fix the first and second covers rotatably to a fixing body, a first interrupt unit to interrupt power supply to the first operating unit for supplying the developer from the container to the developing unit when the first cover is opened, and a second interrupt unit to interrupt power supply to at least the second operating unit for operating the developing unit when the first cover is opened.

The second cover may be a cover provided openably to cover a conveying path of the transfer medium and take out the transfer medium jammed in the transfer path.

The second interrupt unit may interrupt power supply to a heating mechanism, which heats a transfer medium transferred with the developer and fuses and fixes the developer.

Further, the cover open/close unit according to the above embodiment has a first cover rotated to open/close, a second cover rotated to open/close on the same rotating axis as the first cover, a first knob formed on a first surface of the first cover, and a second knob formed on a second surface different from the first surface of the second cover.

The cover open/close unit may have further a fixing body to which the first and second cover are openably fixed, a first connecting member to connect the first and second covers, and a second connecting member to connect the fixing body and second cover.

The first knob and first connecting member may be positioned on a straight line orthogonal to the rotating axis.

The second knob and second connecting member may be positioned on a straight line orthogonal to the rotating axis.

The first and second connecting members may be positioned on a straight line orthogonal to the rotating axis.

The first connecting member may be placed close to the first knob, and the second connecting member may be placed close to the second knob.

The connecting force of the first connecting member may be smaller than the connecting force of the second connecting member.

At least one of the first and second connecting members may include a magnet.

The image forming apparatus according to the above embodiment is an image forming apparatus which transfers the developer supplied from a developing unit to a transfer medium, and fuses and fixes the developer to form an image on the transfer medium, comprising a first cover rotated to open/close for replacing a container containing the developer, a second cover rotated to open/close on the same rotating axis as the first cover, a first knob formed on a first surface of the first cover, a second knob formed on a second surface different from the first surface of the second cover, a first interrupt unit to interrupt power supply to the first operating unit for supplying the developer from the containing container to the developing unit when the first cover is opened, and a second interrupt unit to interrupt power supply to at least the second operating unit for operating the developing unit when the first cover is opened.

What is claimed is:

1. An image forming apparatus, comprising:

an image carrier to carry an electrostatic latent image, the image carrier having a longitudinal axis which is orthogonal to a transfer medium conveying direction;

a developer containing container to contain developer, a longitudinal direction of the developer containing container extending in a direction parallel to the transfer medium conveying direction;

a developing unit which supplies the image carrier with the developer supplied from the developer containing container to form a developer image;

a fixing unit which applies heat and pressure to a transfer medium transferred with the developer image formed on the image carrier, and fuses and fixes the developer image to the transfer medium;

a main body case to contain at least the image carrier, developing unit and fixing unit; and a protection cover which is placed between the main body case and the developer containing container, and has a three-dimensional structure to form an air layer in a clearance to the main body case, the protection cover extending in a direction parallel to the transfer medium conveying direction and opposing to an axial end portion of the image carrier.

2. The image forming apparatus according to claim 1, wherein the protection cover is made of insulating material.

3. The image forming apparatus according to claim 1, further comprising a holding member which is arranged between the protection cover and developer containing container and holds the developer containing container.

4. The image forming apparatus according to claim 1, wherein the protection cover is placed in a clearance between the fixing unit and developer containing container, and has a heat insulation guide to prevent radiation from the fixing unit.

5. An image forming apparatus, comprising:

an image carrier to carry an electrostatic latent image;

a developer containing container to contain developer;

a developing unit which supplies the image carrier with the developer supplied from the developer containing container to form a developer image;

a fixing unit which applies heat and pressure to a transfer medium transferred with the developer image formed on the image carrier, and fuses and fixes the developer image to the transfer medium;

a main body case to contain at least the image carrier, developing unit and fixing unit;

a protection cover which is placed between the main body case and developer containing container, and has a three-dimensional structure to form an air layer in a clearance to the main body case;

a first cover provided rotatably in the main body case;

a second cover rotated to open/close on the same rotating axis as the first cover;

a first interrupt unit which interrupts power supply to a first operating unit for supplying the developer from the developer containing container to the developing unit, when the first cover is opened; and a second interrupt unit which interrupts power supply to a second operating unit for operating at least the developing unit, when the second cover is opened.

6. The image forming apparatus according to claim 5, wherein the protection cover is made of insulating material.

7. The image forming apparatus according to claim 5, wherein a longitudinal direction of the developer containing container is parallel to a transfer medium conveying direction.

8. The image forming apparatus according to claim 5, wherein the protection cover is placed parallel to a transfer medium conveying direction.

9. The image forming apparatus according to claim 5, further comprising a holding member which is arranged between the protection cover and developer containing container and holds the developer containing container.

10. The image forming apparatus according to claim 5, wherein the protection cover is placed in a clearance between the fixing unit and developer containing container, and has a heat insulation guide to prevent radiation from the fixing unit.

11. The image forming apparatus according to claim 5, wherein the image carrier has a longitudinal axis which is orthogonal to a transfer medium conveying direction, the protection cover and the developer containing container extend in a direction parallel to the transfer medium conveying direction, and the protection cover opposes to an axial end portion of the image carrier.

12. The image forming apparatus according to claim 5, wherein the first cover is arranged to cover the developer containing container at a closed position, the protection cover is arranged to oppose to the closed first cover, and the developer containing container is arranged between the protection cover and the closed first cover.

* * * * *